US006554243B2

(12) United States Patent
Davis et al.

(10) Patent No.: US 6,554,243 B2
(45) **Date of Patent: *Apr. 29, 2003**

(54) ROLLABLE SPORTS BASE

(75) Inventors: Mark E. Davis, Wauwatosa, WI (US); Ronald A. White, N. Prairie, WI (US); Keith Kristiansen, Stratford, CT (US); Michael Ballone, New Providence, NJ (US); Gary Grossman, Riverside, CT (US)

(73) Assignee: Huffy Corporation, Miamisburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/813,823

(22) Filed: Mar. 22, 2001

(65) Prior Publication Data

US 2001/0045498 A1 Nov. 29, 2001

Related U.S. Application Data

(62) Division of application No. 09/275,021, filed on Mar. 24, 1999, now Pat. No. 6,427,963.

(51) Int. Cl.[7] ..... F16M 13/00

(52) U.S. Cl. ..... 248/519; 248/129; 248/188.2; 473/479; 473/481; 473/483

(58) Field of Search ..... 248/519, 521, 248/525, 528, 188.2, 910, 145.6, 685, 159, 161, 127, 129; 473/479, 481, 484, 476, 472, 485; 280/47.25, 47.26; 135/99

(56) References Cited

U.S. PATENT DOCUMENTS

| | | | | |
|---|---|---|---|---|
| 2,783,055 A | | 2/1957 | Michaud | |
| 2,829,390 A | | 4/1958 | Noland | |
| 2,939,705 A | | 6/1960 | McCall, Jr. | |
| 3,404,884 A | | 10/1968 | Sorenson et al. | |
| 3,427,025 A | | 2/1969 | Procter | |
| 3,841,631 A | * | 10/1974 | Dolan | 248/159 |
| 3,999,753 A | | 12/1976 | Desilets et al. | |
| 4,412,679 A | | 11/1983 | Mahoney et al. | |
| 4,417,738 A | | 11/1983 | Kendall | |
| 4,526,367 A | | 7/1985 | Haston et al. | |
| 4,762,331 A | * | 8/1988 | Tucker et al. | 280/30 |
| 4,828,208 A | | 5/1989 | Peterson et al. | |
| 5,039,109 A | | 8/1991 | Mahoney et al. | |
| 5,114,164 A | | 5/1992 | Bothwell et al. | |
| 5,158,319 A | | 10/1992 | Norcia et al. | |
| 5,193,828 A | | 3/1993 | Benvenuti | |
| 5,207,407 A | | 5/1993 | Fitzsimmons et al. | |
| 5,220,740 A | * | 6/1993 | Brault | 248/910 X |
| 5,248,140 A | | 9/1993 | Matherne et al. | |

(List continued on next page.)

FOREIGN PATENT DOCUMENTS

CA 2302005 * 9/2000

*Primary Examiner*—Leslie A. Braun
*Assistant Examiner*—Tan Le
(74) *Attorney, Agent, or Firm*—Howrey Simon Arnold & White, LLP; Michael J. Bell

(57) ABSTRACT

A rollable sports ballast base for supporting a sports apparatus support member comprising a base member having a top and bottom surface. The bottom surface contacts a support surface such as a driveway or other playing surface. There is at least one wheel assembly, retractable from a lowered position to a raised position. The wheel assembly includes a pivoting connector coupled to the base member and a wheel bracket coupled to the pivoting connector. The wheel bracket includes an axle, at least one wheel, and a handle extending outwardly from the wheel bracket. The handle is used to pivotally rotate the wheel assembly about a transverse axis. When the handle is rotated away from the base member, the wheel assembly is placed in a lowered position whereby the wheel contacts the support surface thus separating the bottom surface of the base member from the support surface.

6 Claims, 9 Drawing Sheets

U.S. PATENT DOCUMENTS 5,249,438 A 10/1993 Rhaney et al.
5,259,612 A 11/1993 Matherne et al.
5,308,302 A 5/1994 Miller
5,313,817 A 5/1994 Meinders
5,348,326 A 9/1994 Fullenkamp et al.
5,354,049 A * 10/1994 Metherne et al. ..... 248/519 X
5,377,976 A 1/1995 Matherne et al.
5,390,914 A 2/1995 Schroeder
5,415,393 A 5/1995 Fitzsimmons et al.
5,478,068 A 12/1995 Schroeder
5,615,451 A 4/1997 Peterson et al.
5,632,480 A 5/1997 Davis et al.
5,667,230 A 9/1997 Riley et al.
5,672,130 A 9/1997 O'Connell et al.
5,709,397 A 1/1998 Hall
5,716,186 A 2/1998 Jensen et al.
5,730,668 A 3/1998 Hege et al.
5,758,752 A 6/1998 King et al.
5,772,167 A 6/1998 Koole
5,775,650 A 7/1998 Fox
5,807,195 A * 9/1998 Westbrook ..... 473/447
5,823,550 A 10/1998 Bennett et al.
5,899,467 A 5/1999 Henkel
5,944,291 A * 8/1999 Kato et al. ..... 248/188.2
6,027,418 A * 2/2000 Van Nimwegen et al. .. 473/481
6,053,825 A * 4/2000 Allen et al. ..... 473/479
6,089,666 A * 7/2000 Rosko ..... 248/188.2 X
6,117,027 A * 9/2000 Davis et al. ..... 473/481
6,427,963 B1 * 8/2002 Davis et al. ..... 248/519

* cited by examiner

ROLLABLE SPORTS BASE

CROSS REFERENCE TO RELATED APPLICATION

This application is a divisional of U.S. patent application Ser. No. 09/275,021, filed Mar. 24, 1999, now U.S. Pat. No. 6,427,963.

BACKGROUND OF THE INVENTION

1. Field of the Invention

The present invention relates in general to sports assemblies and more particularly to portable sports assemblies that are rollable.

2. Description of the Related Art

Various types of sports assemblies, and in particular, basketball goal support assemblies, volleyball net support assemblies and the like, have been proposed and used in the past. Such proposals have recognized that stability and portability are desirable if perhaps competing characteristics. In the past, providing both stability and portability in a particular construction has come at the price of requiring a more complex structural arrangement and, in many instances, the use of additional equipment to serve as a way of either transporting or stabilizing the assembly.

While there are patents which disclose the use of wheels or casters rigidly mounted to the base of a sports assembly, one must typically tilt the entire assembly for the wheels to engage the support surface. In the tilted position, the mover bears a significant portion of the assembly weight and stability. In several basketball sports assemblies, the basketball backboard is oversized and extremely heavy. The average person is not able to readily tilt the entire assembly. In the event that one is able to tilt or overturn the assembly, they would still have to bear a significant portion of the weight of the assembly during transportation.

Moreover, there are patents which disclose apparatuses having retractable wheels that can be deployed to engage the ground. However, in some of these apparatuses, one is still required to substantially tilt the apparatus in order to transport it. Other apparatuses which disclose deployable wheels typically utilize such wheels for added support or stability and do not disclose deployable wheels which are the primary means of transporting the particular apparatus.

Accordingly, there is a need in the art for a rollable sports base which is securely in contact with the ground during operation and is easily transported without having to substantially tilt the assembly.

SUMMARY OF THE INVENTION

Accordingly, the present invention is directed to a rollable sports base for supporting a sports apparatus. It is a principal advantage of the present invention to provide a sports base which is stable in operation, yet is easily transported without the need for the person transporting the apparatus to bear the weight of the assembly during transportation.

Additional features and advantages of the invention will be set forth in the description that follows, and in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodied and broadly described, the invention consists of a sports ballast base for supporting a sports apparatus support member comprising a base member having a first edge and a second edge, a top surface and a bottom surface. The bottom surface is adapted to substantially contact a support surface. There is a wheel assembly having at least one wheel for contacting the support surface. The wheel assembly is retractable or displaceable from a lowered position to a raised position such that when in the raised position, the bottom surface of the base member substantially contacts the support surface and in the lowered position the wheel contacts the support surface thereby separating the base member from the support surface.

It is also desirable for the sports ballast base to have two wheel assemblies, a first wheel assembly and a second wheel assembly, for contacting the support surface. One or both of the wheel assemblies are retractable or displaceable from a lowered position to a raised position such that when in the raised position, the bottom surface of the base member substantially contacts the support surface. In the lowered position, both the first and second wheel assemblies contact the support surface thereby separating or elevating the base member from the support surface.

In another embodiment, the invention consists of a similar rollable sports base for supporting a sports apparatus support member wherein the first wheel assembly is displaceable or retractable and comprises a pivoting connector coupled to the base member and a wheel bracket coupled to the pivoting connector. The wheel bracket is adapted to receive an axle and at least one wheel, and is further provided with a handle extending outwardly from the wheel bracket. The handle is used to pivotally rotate the second wheel assembly about a transverse axis such that when the handle is rotated away from the base member, the wheel contacts the support surface and the bottom surface of the base member is separated or elevated from the support surface.

It is an object of the present invention to provide a rollable sports base that is securely in contact with the ground during operation and is easily transported without having to substantially tilt the assembly.

It is a further object of the present invention to provide a rollable sports base having rollers or wheels which are displaceable.

It is yet another object of the present invention to provide a rollable sports base which is easily maneuvered during transportation.

These and other objects of the present invention will become readily apparent upon further review of the following specification and drawings. It is understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and together with the description serve to explain the principles of the invention.

BRIEF DESCRIPTION OF THE DRAWINGS

Similar reference characters denote corresponding features consistently throughout the attached drawings.

DETAILED DESCRIPTION OF THE PREFERRED EMBODIMENTS

Reference will now be made in detail to the present preferred embodiment of the invention, an example of which is illustrated in the accompanying drawings.

Figure 1:
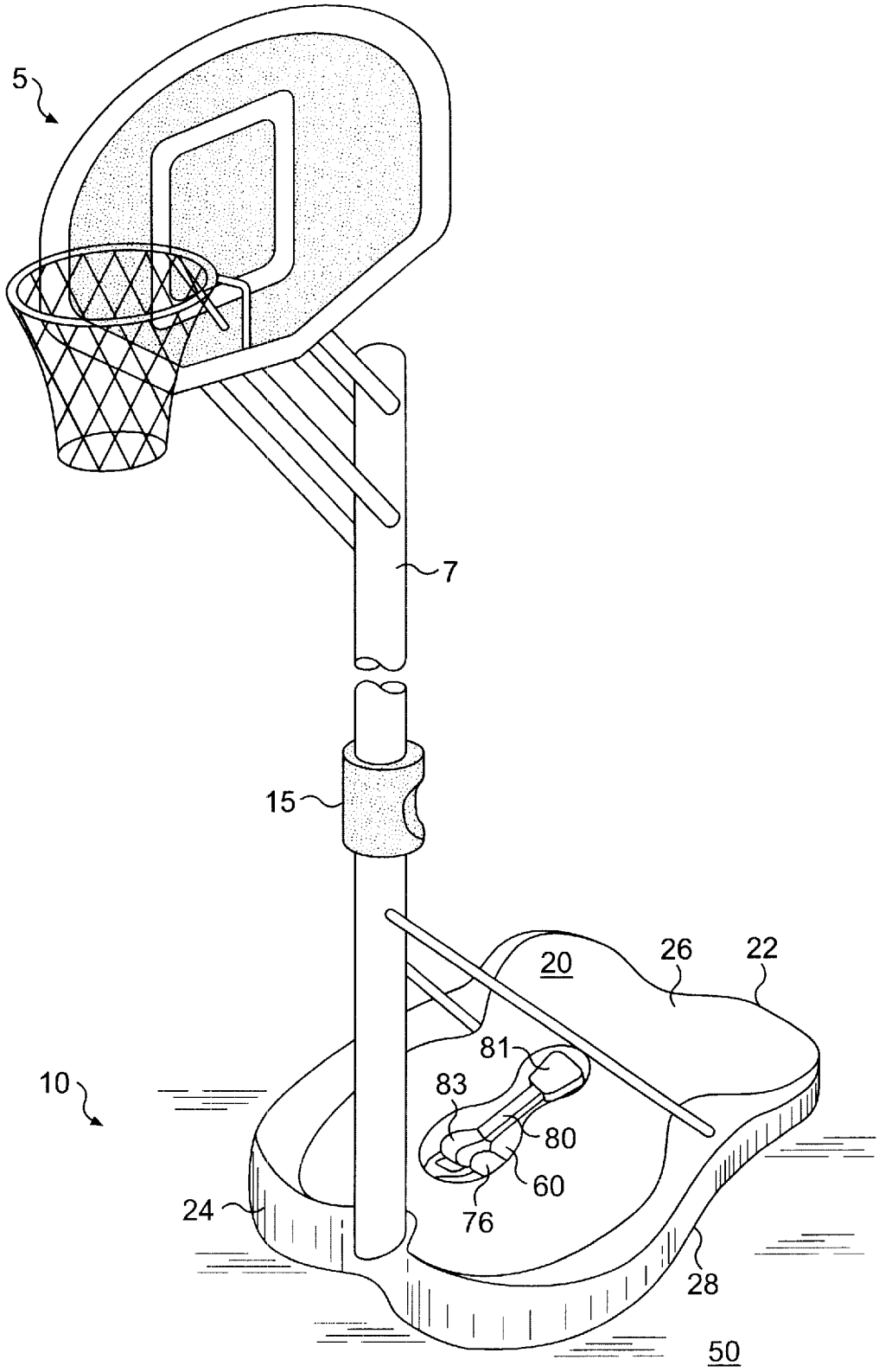
FIG. 1 is a perspective view of a first embodiment of a rollable sports base according to the present invention.
Figure 2:
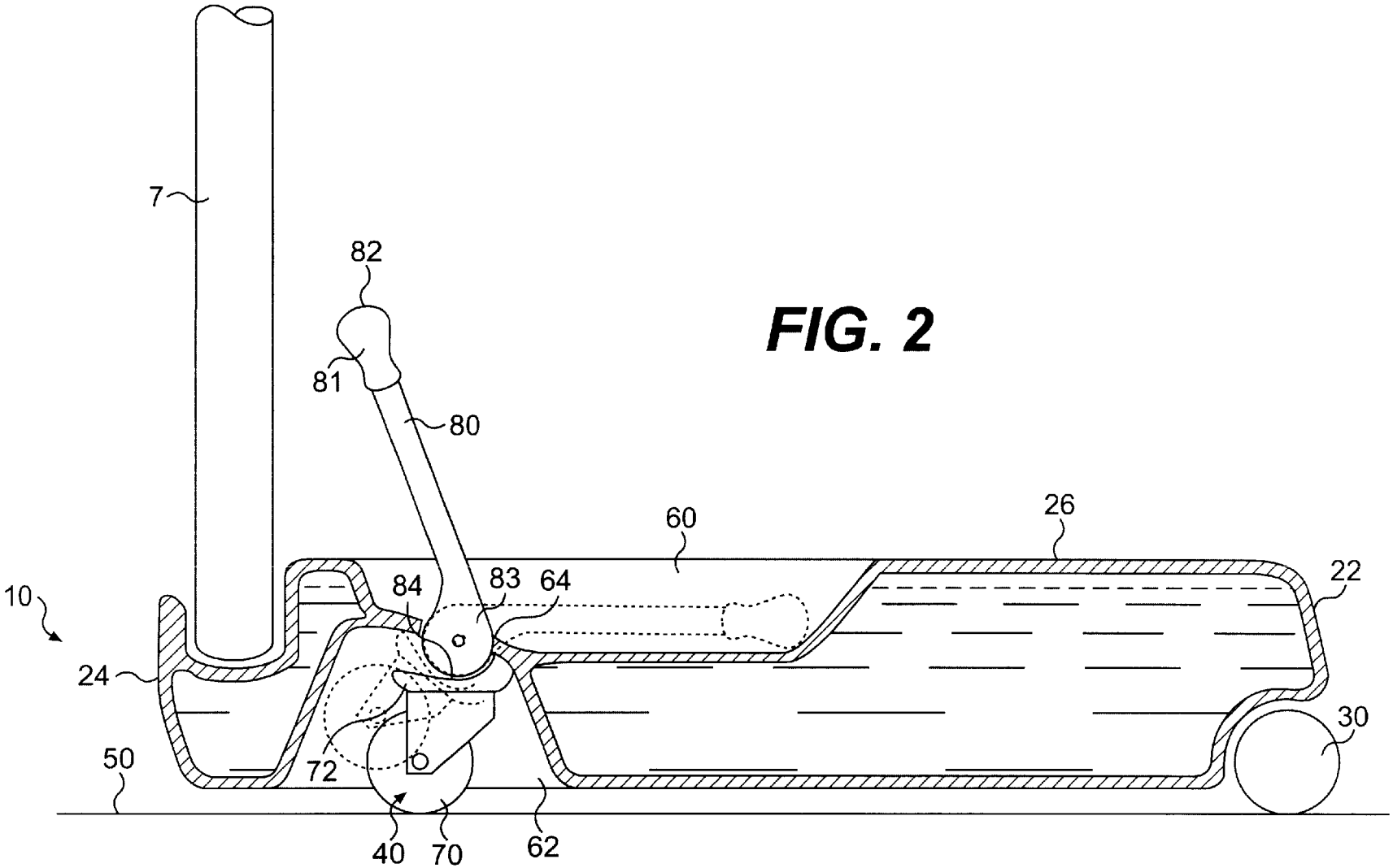
FIG. 2 is a cross sectional side view of the rollable sports base of FIG. 1.

The exemplary embodiment of the rollable sports base is shown in FIGS. 1 and 2 and is designated generally by reference numeral 10. As embodied herein and referring to FIGS. 1 and 2, the rollable sports base 10 is preferably attached to a portable basketball goal assembly 5 and includes a base member 20 which has a first edge 22 and a second edge 24, and a top surface 26 and a bottom surface 28. The bottom surface 28 is adapted to contact a support surface 50 such as a driveway or other playing surface. There is at least one retractable or displaceable wheel assembly 30 having at least one wheel 70 for contacting the support surface. It is preferred that there be two wheel assemblies, a second wheel assembly 30 and a first wheel assembly 40, for contacting the support surface 50. One or both of the wheel assemblies are displaceable or retractable from a lowered position to a raised position such that when in the raised position, the bottom surface 28 of the base member 20 substantially contacts the support surface 50. In the lowered position, the wheels 70 of both the second and first wheel assemblies 30, 40 contact the support surface 50 thereby separating or elevating the base member 20 from the support surface 50, such that the base 10 is rollable. A displaceable wheel assembly has the ability to change its position relative to the support surface 50 and the base 10. A retractable wheel assembly has the ability to be drawn back within the base 10 from a position where it is displaced from the base 10.

Although it need not be present, it is desirable for the base member 20 to have a first recession 60 in the top surface 26 of the base member 20 and a second recession 62 in the bottom surface 28 of the base member 20. A hole 64 is defined through the base member 20 which extends from the first recession 60 through to the top surface 26. Where there is a second recession 62, the top of the recession is essentially the top surface 26. In practice, either one of the wheel assemblies 30, 40 or both wheel assemblies 30, 40 may be displaceable. In a preferred embodiment, the second wheel assembly 30 is fixed in position such that the second wheel assembly 30 engages the support surface 50 during routine use and the first wheel assembly 40 is displaceable or retractable.

Where the first wheel assembly 40 is retractable it preferably comprises a caster, wheel, or similar roller 70, having a top portion 72 attached to the base member 20 and a retraction device 80. The retraction device 80 has a first end 82 and a second end 84 and is pivotally attached at the second end 84 by a mounting bracket 76 disposed within the hole 64 defined between the first recession 60 and second recession 62. The second end 84 of the retraction device 80 is adapted to engage the top portion 72 of the caster 70. It is preferred that the caster or wheel 70 be pivotally attached to the base member 20 within the second recession 62, such that downward force on the top portion 72 of the caster 70 causes the caster 70 to engage the support surface 50 thereby separating the base member 20 from the support surface 50, thus being easily transported or rollable.

As depicted in FIGS. 1 and 2, it is preferred that the retraction device 80 is a lever adapted to communicate with either the top surface 26 or the first recession 60. The second end 84 of the retraction device 80 is provided with a cam 83 thereon and the first end 82 of the retraction device is provided with a handle 81 such that when the first end 82 is separated from the top surface 26 or the first recession 60, the second end 84 rollably communicates with the top portion 72 of the caster 70 such that the caster 70 contacts the support surface 50 and the bottom surface 28 of the base member 20 is separated or elevated away from the support surface 50, so the base 10 is rollable.

In order to provide increased maneuverability and a more secure grip, the sports apparatus support member 7 further comprises a handgrip 15 positioned thereon. The handgrip 15 is preferably made of a pliable material such as foam rubber in order to ensure a tight grip, but can be made of essentially any material that would serve the purpose of the invention.

Figure 3:
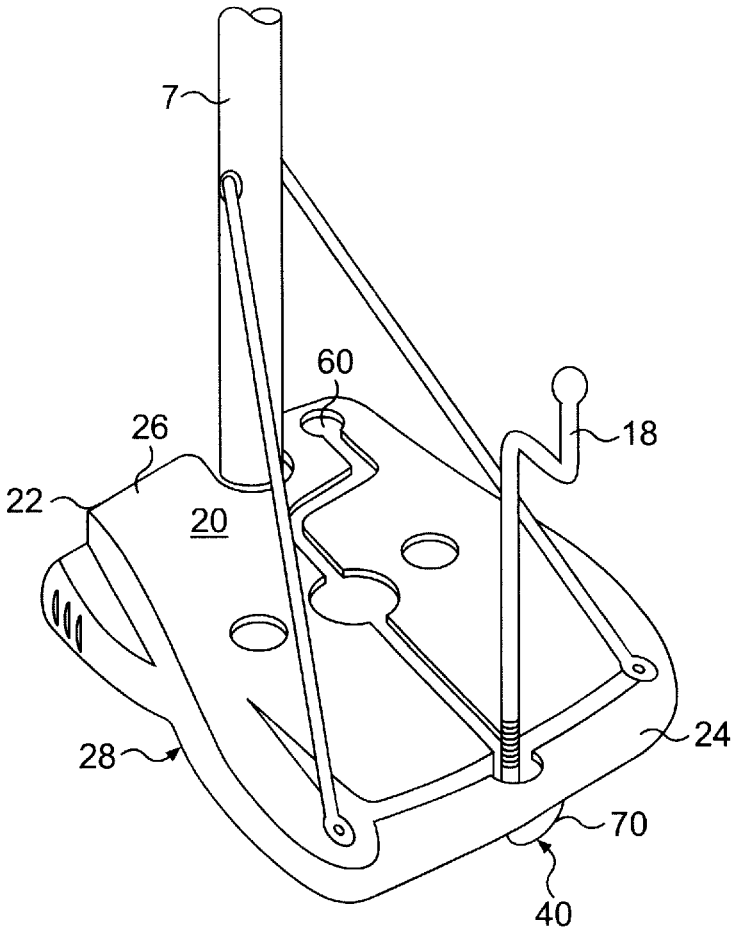
FIG. 3 is a perspective view of a further embodiment of a rollable sports base according to the present invention utilizing a screw-jack handle.
Figure 4:
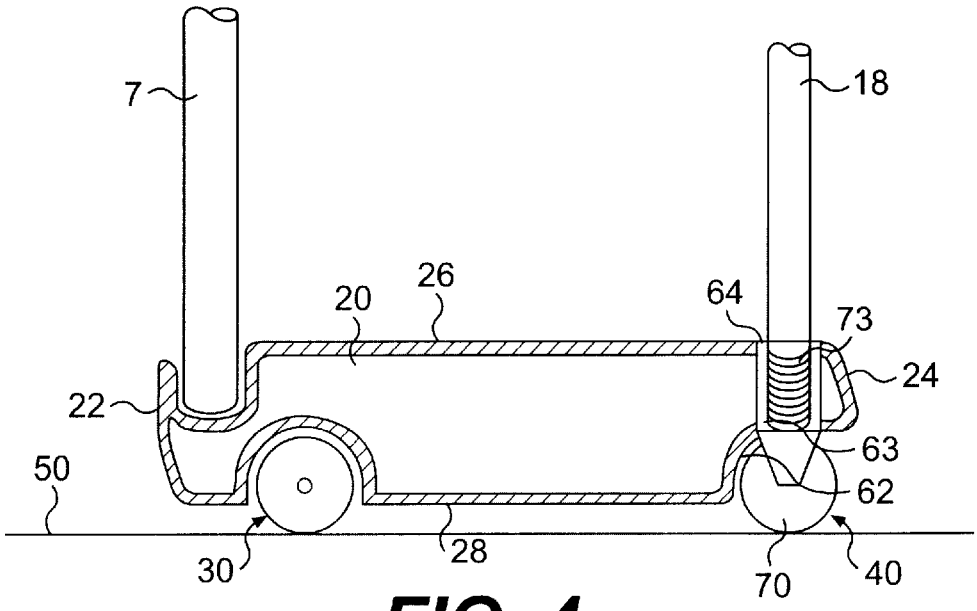
FIG. 4 is a cross sectional view of the rollable sports base of FIG. 3.

In another preferred embodiment depicted in FIGS. 3 and 4 the hole 64 in the base member 20 is adapted to communicate with threads 73 provided on the top portion 72 of the caster 70. The handle 18 in the depicted embodiment is adapted to be easily rotated about a vertical axis perpendicular to the bottom surface 28 of the base member 20. Moreover, it is preferred that the handle 18 is adapted to slidably contact a first recession 60 during use of the sports apparatus. When the handle 18 is lifted away or separated from the first recession 60, rotation of the handle 18 about the vertical axis displaces the caster 70 relative to the support surface 50. For example, clockwise rotation of the handle 18 about the vertical axis displaces the caster 70 towards the support surface 50, thereby eventually contacting the support surface 50 and elevating the base member 20 away from the support surface 50. Counterclockwise rotation of the handle 18 about the vertical axis will displace the caster 70 away from the support surface 50 towards the base member 20.

Figure 5:
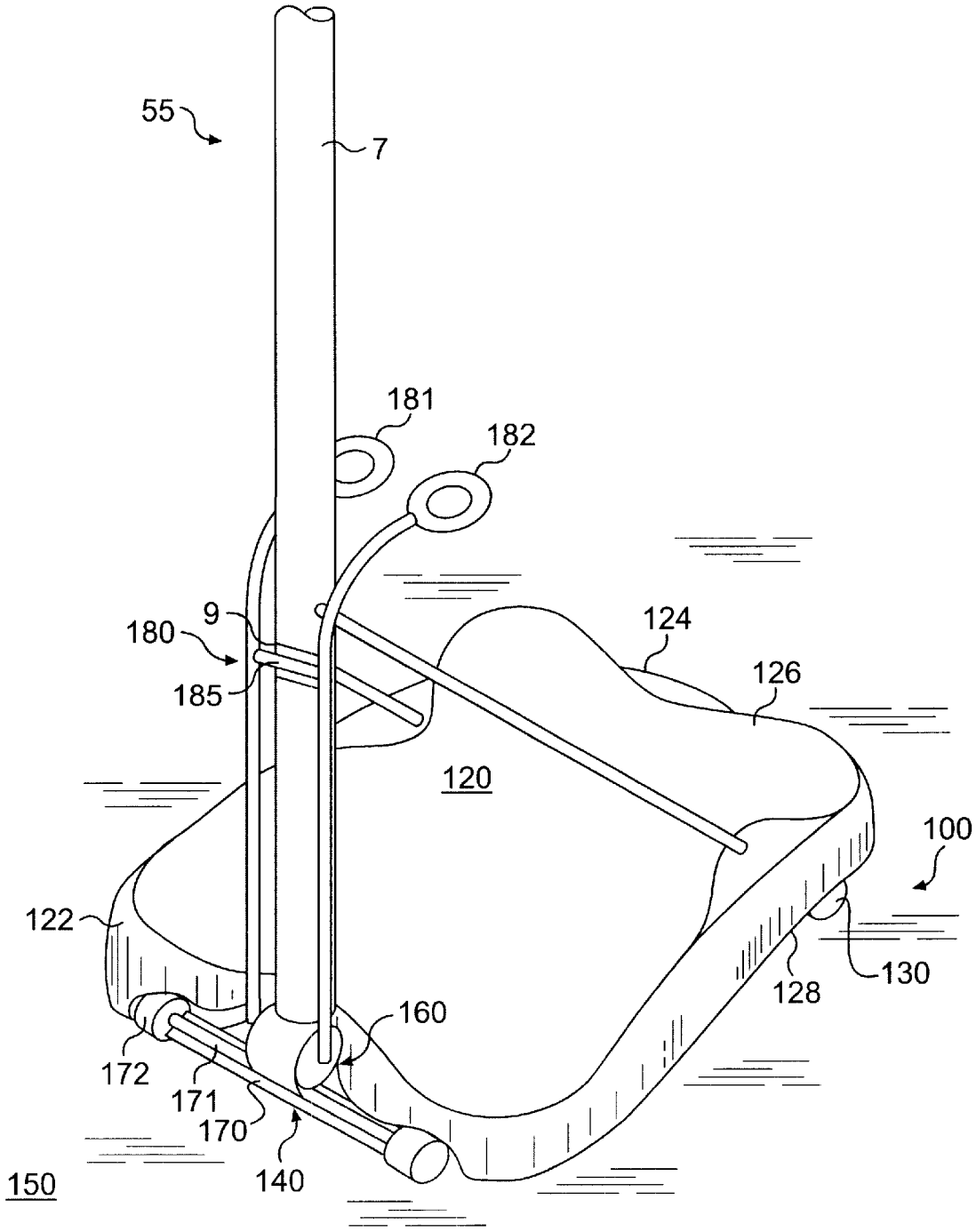
FIG. 5 is a perspective view of another embodiment of a rollable sports base according to the present invention.
Figure 6:
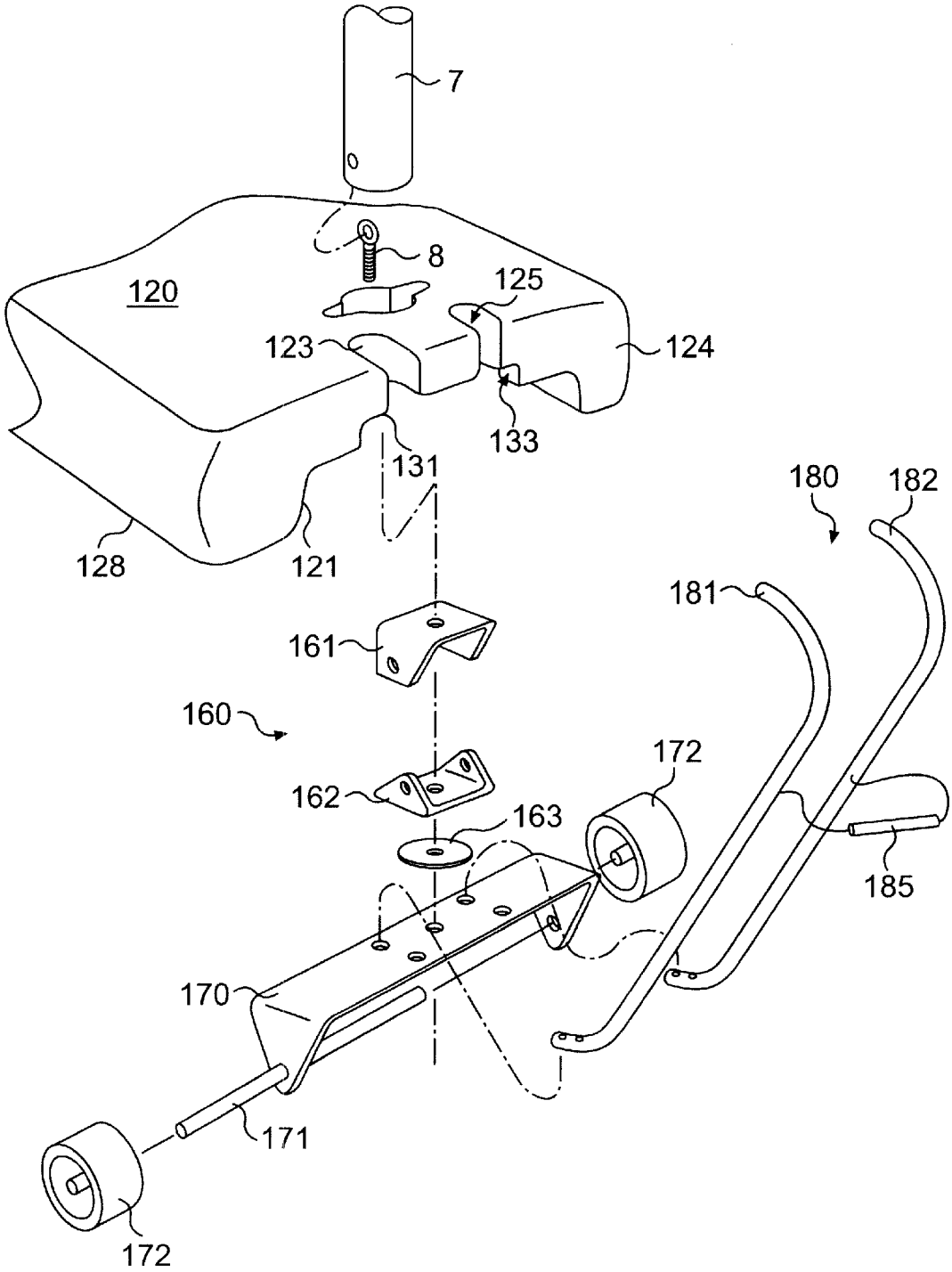
FIG. 6 is an exploded view of a wheel assembly of the rollable sports base of FIG. 5.

In another embodiment of the present invention, and referring to FIGS. 5 and 6, the rollable sports base 100 is preferably attached to a portable basketball goal assembly 55 and includes a base member 120 which has a first edge 122 and a second edge 124, and a top surface 126 and a bottom surface 128. The bottom surface 128 is adapted to contact a support surface 150 such as a driveway or other playing surface. There are two wheel assemblies, a second wheel assembly 130 and a first wheel assembly 140, having wheels 172 for contacting the support surface 150. One or both of the wheel assemblies are retractable from a lowered position to a raised position such that when in the raised position, the bottom surface 128 of the base member 120 substantially contacts the support surface 150. In the lowered position, wheels 172 on both the first and second wheel assemblies 140, 130 contact the support surface 150 thereby separating or elevating the base member 120 from the support surface 150 such that the base 100 is rollable.

It is preferred that the second wheel assembly 130 is fixed in position such that the second wheel assembly 130 engages the support surface 150. The first wheel assembly 140 is retractable and comprises a pivoting connector 160 coupled to the base member 120, and a wheel bracket 170 coupled to the pivoting connector 160 adapted to receive an axle 171 and at least one wheel 172. In the embodiment where only one wheel is present, the center of the wheel is preferably positioned beneath the support member 7. The wheel bracket 170 is further provided with a handle 180 extending outwardly from the wheel bracket 170 for pivotally rotating the first wheel assembly 140 about a transverse axis such that when the handle 180 is rotated away from the base member 120, the wheel 172 contacts the support surface 150 and the bottom surface 128 of the base member 120 is separated or elevated away from the support surface 150, such that the base 100 is rollable.

It is preferred that the base member 120 be provided with a first recession 121 in the bottom surface 128 and that the pivoting connector 160 be coupled to the bottom surface 128 of the base member 120 within the first recession 121. The handle 180 comprises a first element 181 which is parallel to a second element 182, each element extending outwardly from the wheel bracket 170. The first element 181 of the handle 180 and the second element 182 of the handle 180 could be connected by a linkage member 185 that is disposed between each element. The sports apparatus support member 7 would be provided with a corresponding indentation 9 therein for communicating with, and lockably receiving, the linkage member 185.

The base member 128 is preferably provided with a first indent 123 and a second indent 125 in the first edge 122 of the base member 120. The first and second indents 123, 125 are adapted to receive the first element 181 and second element 182 of the handle 180 respectively. When the first element 181 and second element 182 of the handle 180 are positioned such that they slidably engage the first indent 123 and second indent 125, the second wheel assembly 140 is retracted in the first recession 121 and the bottom surface 128 of the base member 120 is in contact with the support surface 150. When the handle 180 is rotated away from the base member 120 the first wheel assembly 140 deploys such that the wheels 172 contact the support surface 150 and thereby separate the base member 120 from the support surface 150, such that the base 100 is rollable.

The pivoting connector 160 preferably comprises an upper pivot bracket 161 coupled to the base member 120, a lower pivot bracket 162 pivotally connected to the upper pivot bracket 161, and a swivel connector 163 coupled between the lower pivot bracket and the wheel bracket 170. The swivel connector 163 serves as an anti-friction device between the wheel bracket 170 and the pivot bracket 162. The pivoting connector 160 is connected to the sports apparatus 55 by an eyebolt 8 provided within the support member 7, proximate the base member 120, which threadedly engages the upper pivot bracket 161. The connection between the lower pivot bracket 162 and upper pivot bracket 161 enables the first wheel assembly 140 to swivel about the transverse axis. The swivel connector 163 enables the first wheel assembly 140 to swivel about a vertical axis perpendicular to the bottom surface 128 of the base member 120.

The ability of the first wheel assembly 140 to pivot around the vertical axis is limited in order to prevent the apparatus 55 from hyper-extending around the vertical axis. In order to limit the rotation, the base member 120 further comprises a second recession 131 within the first recession 121 thereby defining a flange 133 for contacting the handle 180. The flange 133 defines a limit for an arc of rotation about the vertical axis which the first wheel assembly 140 can rotate. Preferably, the arc is about (50 degrees (i.e. 30 degrees to either side of the centerline).

Figure 7:
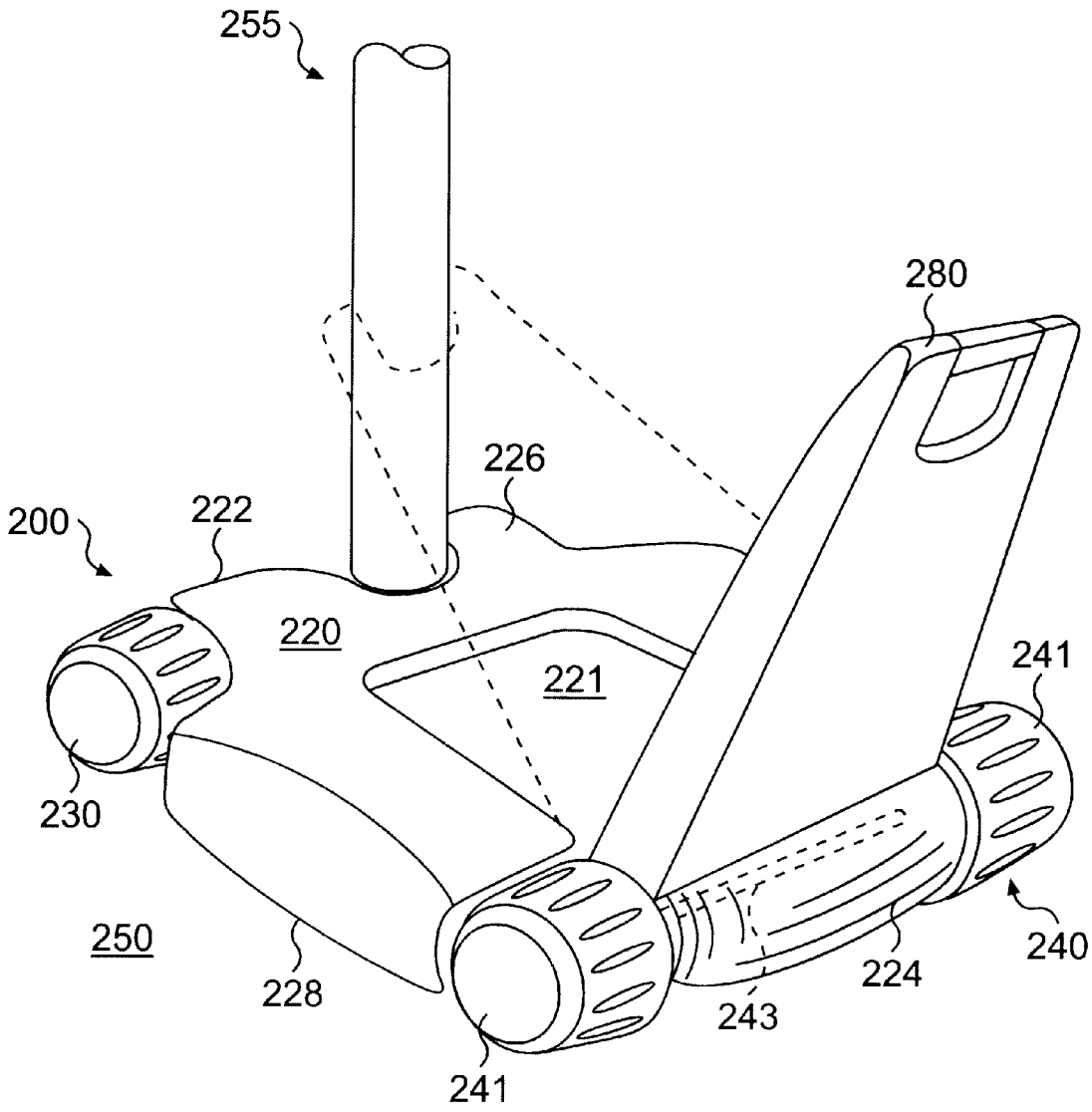
FIG. 7 is a perspective view of yet another embodiment of a rollable sports base according to the present invention depicting a recessed handle.

In yet another embodiment of the present invention, and referring to FIG. 7, the rollable sports base 200 is preferably attached to a portable basketball goal assembly 255 and includes a base member 220 which has a first edge 222 and a second edge 224, and a top surface 226 and a bottom surface 228. The bottom surface 228 is adapted to contact a support surface 250 such as a driveway or other playing surface. There are two wheel assemblies, a first wheel assembly 240 and a second wheel assembly 230, provided with at least one wheel 241 for contacting the support surface 250. One or both of the wheel assemblies 240, 230 are retractable from a lowered position to a raised position such that when in the raised position, the bottom surface 228 of the base member 220 substantially contacts the support surface 250. In the lowered position, both the first and second wheel assemblies 240, 230 contact the support surface 250 thereby separating or elevating the base member 220 from the support surface 250, such that the base 200 is rollable.

It is preferred that the second wheel assembly 230 is fixed in position such that the second wheel assembly 230 engages the support surface 250. The first wheel assembly 240 is retractable and is pivotally coupled to the base member 220. The first wheel assembly 240 is further provided with a handle 280 extending outwardly therefrom for rotating it about a transverse axis such that when the handle 280 is rotated away from the base member 220, the wheels 241 contact the support surface 250 and the bottom surface 228 of the base member 220 is separated or elevated away from the support surface 250.

It is preferred that the base member 220 be provided with a first recession 221 in the top surface 226 for receiving the handle 280. It is also desirable, in the present embodiment, that the first wheel assembly 240 comprises two wheels 241, each disposed on opposite sides of the axle 243. It is clear from the foregoing discussion that the retractable first wheel assembly 240 can be located at either the first edge 222 or the second edge 224 of the base member 220. Additionally, depending on the particular configuration, the handle 280 can be situated such that it rotates away from the base member 220 or towards the base member 220. As an alternative to having a first recession 221 in the top surface 226, the handle 280 may be configured to contact the support pole of the assembly 255.

In another embodiment of the present invention, and referring to FIGS. 8*a*–8*e*, the rollable sports base 300 is preferably attached to a portable basketball goal assembly 355 and includes a base member 320 which has a first edge 322 and a second edge 323, a first side 324 and a second side 325, and a top surface 326 and a bottom surface 328. The bottom surface 328 is adapted to contact a support surface 350 such as a driveway or other playing surface. There are two wheel assemblies, a first wheel assembly 330 and a second wheel assembly 340, having wheels 370 for contacting the support surface 350.

The first and second wheel assemblies 330, 340 are retractable from a lowered position to a raised position such that when in the raised position, the bottom surface 328 of the base member 320 substantially contacts the support surface 350 and in the lowered position, the wheels 370 contact the support surface 350 thereby separating the base member 320 from the support surface 350.

Figure 8A:
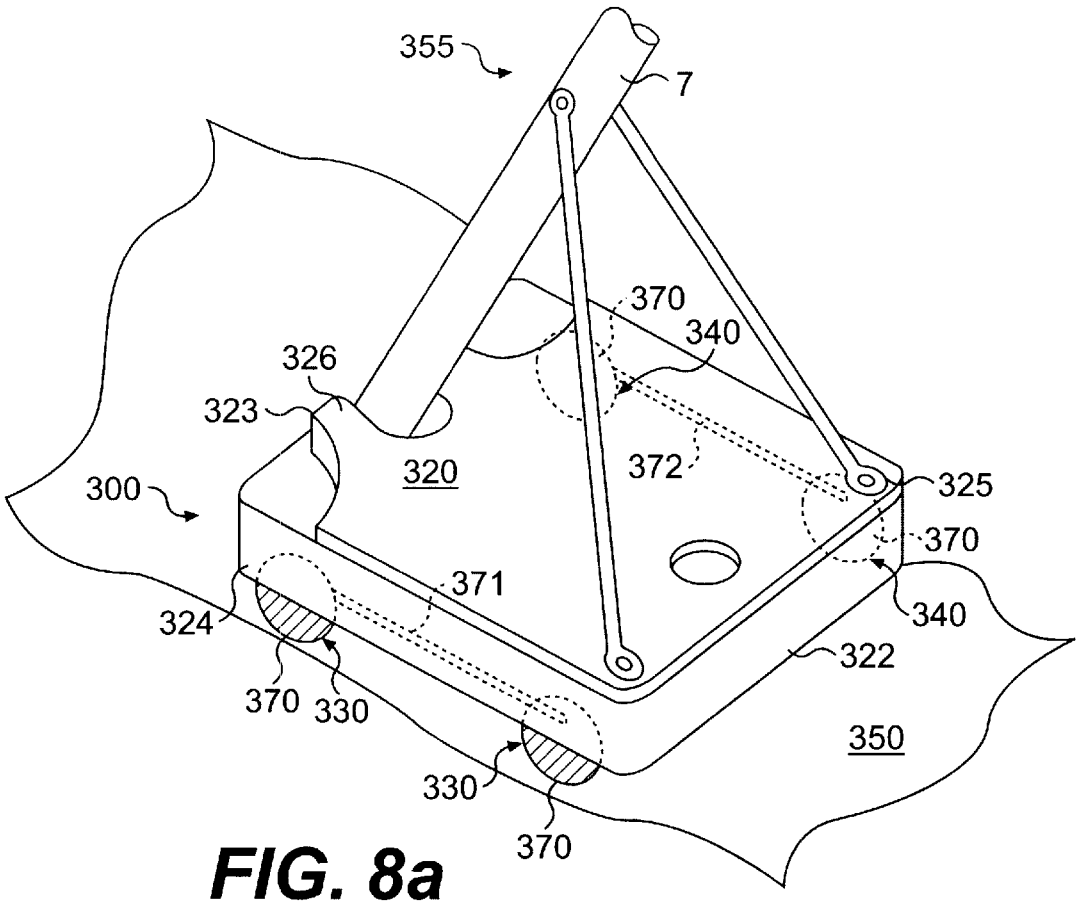
FIG. 8*a* is a perspective view of another embodiment of a rollable sports base according to the present invention.
Figure 8B:
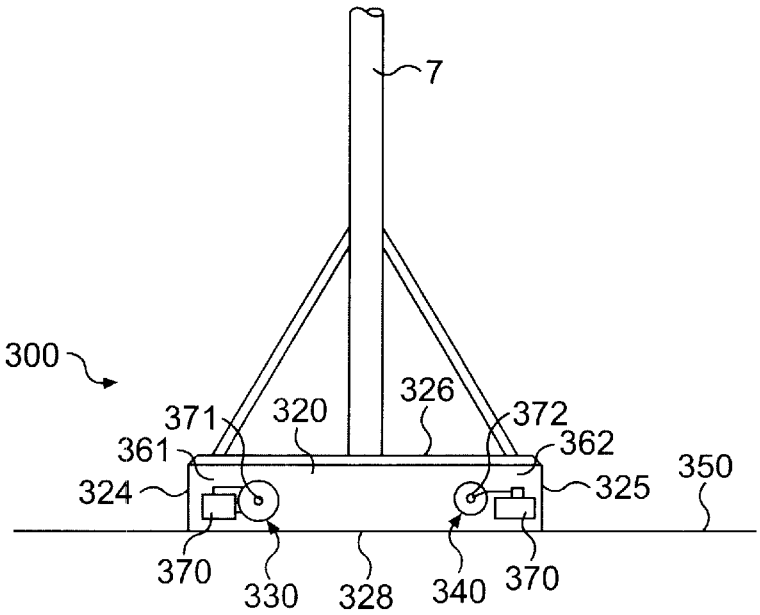
FIG. 8*b* is a front view of the embodiment of the present invention according to FIG. 8*a*.
Figure 8C:
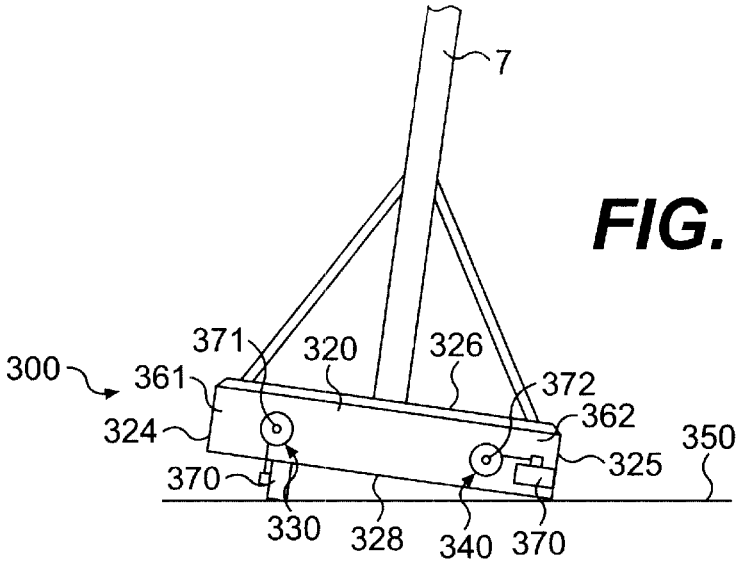
FIG. 8*c* is a front view of the embodiment of the present invention according to FIGS. 8*a* and 8*b*.
Figure 8D:
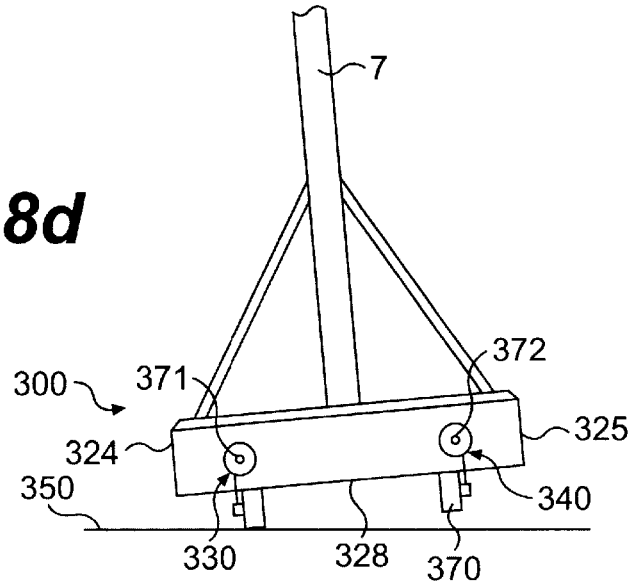
FIG. 8*d* is a front view of the embodiment of the present invention according to FIGS. 8*a,* 8*b,* and 8*c*.
Figure 8E:
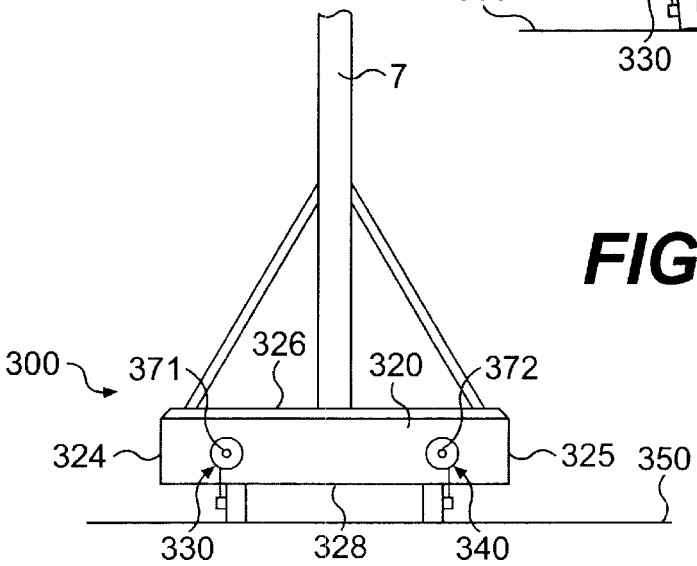
FIG. 8*e* is a front view of the embodiment of the present invention according to FIGS. 8*a,* 8*b,* 8*c,* and 8*d*.

The bottom surface 328 of the base member 320 is preferably provided with a first recession 361 and a second recession 362 for receiving the first wheel assembly 330 and second wheel assembly 340 respectively as shown in FIG. 8*b*. The first wheel assembly 330 is positioned proximate the first side 324 of the base member 320 and the second wheel assembly 340 is positioned proximate the second side 325 of the base member 320 and each comprises a pair of wheels 370 connected to opposite ends of a first axle member 371 and a second axle member 372 respectively. Each axle member 371, 372 is pivotally connected to the base member 320 and extends from the first edge 322 of the base member 320 to the second edge 323 of the base member 320. While the sports assembly 355 is in use, the wheel assemblies 330, 340 are locked in their respective recessions 361, 362 using methods known to one of ordinary skill in the art such as a detent mechanism or the like. Although it is preferred that the wheels 370 are mounted to axles, it would be obvious to one of ordinary skill in the art to individually mount each wheel 370 such that each one may be raised and lowered individually. When a force is applied to the sports apparatus support member 7 in a direction substantially perpendicular to the first side 324 of the base member 320, the first wheel assembly 330 is adapted to deploy such that the wheel 370 engages the support surface 350 as shown in FIG. 8*c*. When a force is applied to the sports apparatus support member in a direction substantially perpendicular to the second side 325 of the base member 320, the second wheel assembly 340 is able to deploy such that the wheel 370 engages the support surface 350 as shown in FIG. 8*d*. When both wheel assemblies 330, 340 are deployed, the base member 320 is separated from the support surface 350 such that the base 300 is rollable.

Figure 9A:
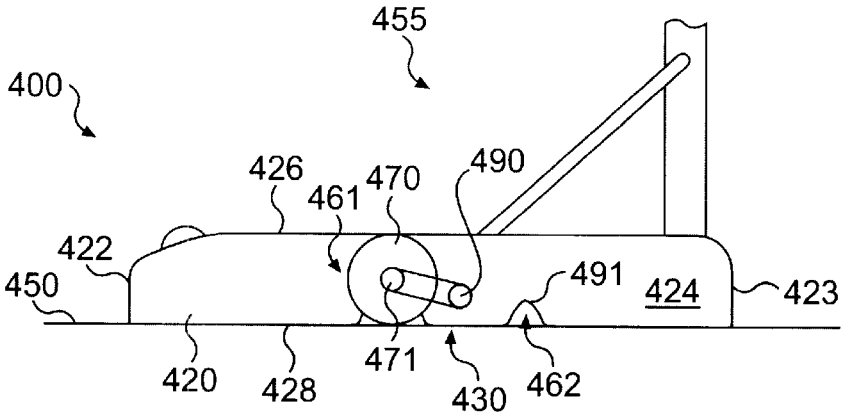
FIG. 9*a* is a side view of another embodiment of the present invention.
Figure 9B:
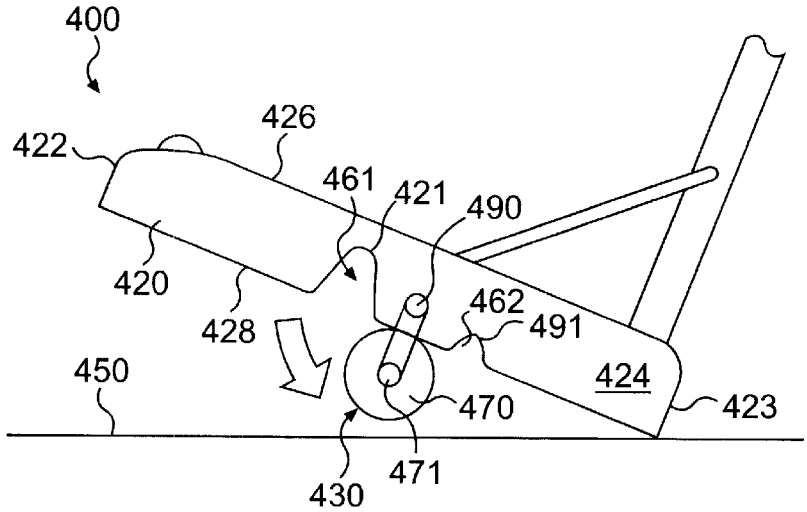
FIG. 9*b* is a side view of the embodiment of the present invention according to FIG. 9*a*.
Figure 9C:
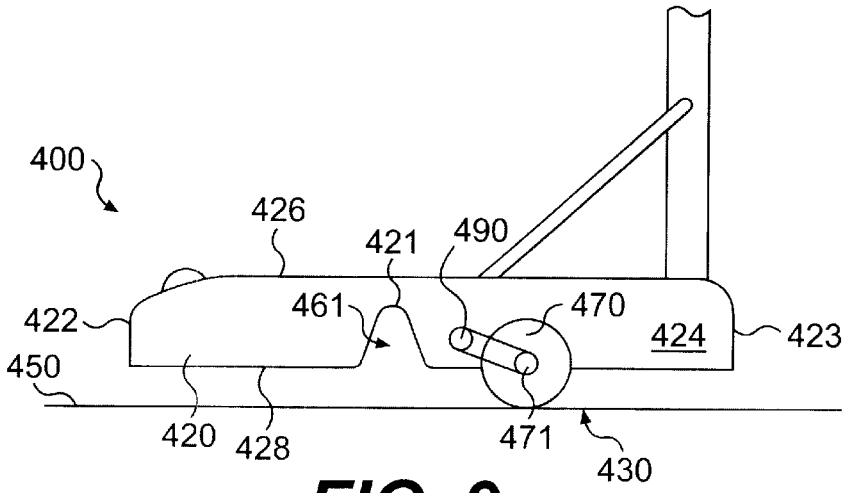
FIG. 9*c* is a side view of the embodiment of the present invention according to FIGS. 9*a* and 9*b*.

In another embodiment of the present invention, and referring to FIGS. 9*a*–9*c*, the rollable sports base 400 is preferably attached to a portable basketball goal assembly 455 and includes a base member 420 which has a first edge 422 and a second edge 423, a first side 424 and a second side 425, and a top surface 426 and a bottom surface 428. The bottom surface 428 is adapted to contact a support surface 450 such as a driveway or other playing surface. There is at least one wheel assembly 430 having at least one wheel 470 for contacting the support surface 450.

The deployable first wheel assembly 430 is deployable from a lowered position to a raised position such that when in the raised position, the bottom surface 428 of the base member 420 substantially contacts the support surface 450 and in the lowered position, the wheel 470 contacts the support surface 450 thereby separating the base member 420 from the support surface 450.

The bottom surface 428 of the base member 420 is preferably provided with a first recession 461 and a second recession 462 for receiving the wheel assembly 430. The deployable first wheel assembly 430 is preferably connected to the bottom surface 428 of the base member 420 by a pivot member 490. The wheel 470 is provided with an axle member 471 configured to engage the base member 420 adjacent the first recession 461 and the second recession 462. While the sports assembly 455 is in use, the wheel assembly 430 resides substantially within the first recession 461. Preferably, the axle member 471 engages the base member 420 at first slots 421 adjacent the first recession 461 or second slots 491 adjacent the second recession 462. When a force is applied to the sports apparatus support member 7 in a direction substantially perpendicular to the first edge 422 of the base member 420, the wheel assembly 430 is adapted to deploy such that the wheel 470 swivels towards the support surface 450 as shown in FIG. 9*b*. The axle member 471 is adapted to engage the base member 420 at slots 421, 491 to allow the wheel 470 to freely spin within the second recession 462 while it engages the support surface 450 as shown in FIG. 9*c*. When a force is applied to the sports apparatus support member in a direction substantially perpendicular to the second edge 423 of the base member 420, the wheel assembly 430 returns to the "in use" position. When the wheel assembly 430 is configured such that the wheel 470 is engaging the support surface 450, the base member 420 is substantially displaced from the support surface 450 and the assembly 455 is easily transported.

It will be apparent to those skilled in the art that various modifications and variations can be made in the rollable sports base of the present invention without departing from the spirit or scope of the invention. It is intended that the present invention covers any method and apparatus related to deployable and retractable wheel assemblies for a sports apparatus. Thus, it is intended that the present invention covers the modifications and variations of this invention provided they come within the scope of the appended claims and their equivalents.

We claim:

1. A rollable basketball apparatus comprising:

a support member having a first end portion and a second end portion;

a basketball goal assembly coupled to the first end portion of said support member;

a base member coupled to the second end portion of said support member, said base member having a top surface and a bottom surface adapted to contact a support surface;

a displaceable first wheel assembly having at least one wheel for contacting the support surface, wherein said first wheel assembly is configured to be displaced from a lowered position to a raised position such that when in the raised position, the at least one wheel of said first wheel assembly is substantially separated from the support surface and the bottom surface of said base member substantially contacts the support surface to support said base member, and when in the lowered position said at least one wheel substantially contacts the support surface to support said base member, thereby substantially separating said base member from the support surface;

a second wheel assembly having at least one wheel for contacting the support surface and fixed in position in a vertical direction such that said at least one wheel engages the support surface; and an actuator coupled to said first wheel assembly;

wherein when said actuator is set to a first position, the at least one wheel of said first wheel assembly is displaced to the lowered position, and when said actuator is set in a second position, the at least one wheel of said first wheel assembly is displaced to the raised position.

2. The rollable basketball apparatus of claim 1, wherein said actuator is a movable handle.

3. The rollable basketball apparatus of claim 2, wherein when said handle is displaced in a first direction, the at least one wheel of said first wheel assembly is displaced to the lowered position, and when said handle is displaced in a second direction, the at least one wheel of said first wheel assembly is displaced to the raised position.

4. The rollable basketball apparatus of claim 1, wherein said actuator is a rotatable handle.

5. The rollable basketball apparatus of claim 4, wherein when said handle is rotated in a first direction, the at least one wheel of said first wheel assembly is displaced to the lowered position, and when said handle is rotated in a second direction, the at least one wheel of said first wheel assembly is displaced to the raised position.

6. The rollable basketball apparatus of claim 1, said base member having a plurality of edge portions and wherein the displaceable first wheel assembly is disposed in a recession in one of the plurality of edge portions.

* * * * *